US008109507B2

(12) United States Patent
Okumura et al.

(10) Patent No.: US 8,109,507 B2
(45) Date of Patent: Feb. 7, 2012

(54) RECORDING APPARATUS

(75) Inventors: Masayuki Okumura, Nagoya (JP); Yuji Sakano, Toyota (JP); Hideki Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/712,568

(22) Filed: Feb. 25, 2010

(65) Prior Publication Data

US 2010/0237554 A1 Sep. 23, 2010

(30) Foreign Application Priority Data

Mar. 19, 2009 (JP) ..... 2009-068878

(51) Int. Cl.
*B65H 7/02* (2006.01)

(52) U.S. Cl. ..... 271/227; 271/228; 271/242; 271/245

(58) Field of Classification Search ..... 271/226–228, 271/242, 245
See application file for complete search history.

(56) References Cited

U.S. PATENT DOCUMENTS

| | | | | | |
|---|---|---|---|---|---|
| 4,986,526 | A | * | 1/1991 | Dastin | 271/227 |
| 5,277,415 | A | | 1/1994 | Kinoshita et al. | |
| 5,362,041 | A | * | 11/1994 | Ryuzaki et al. | 271/236 |
| 5,417,415 | A | * | 5/1995 | Murakami | 271/227 |
| 5,692,744 | A | * | 12/1997 | Funato | 271/242 |
| 5,933,697 | A | * | 8/1999 | Onodera et al. | 399/406 |
| 6,105,957 | A | * | 8/2000 | Miller et al. | 271/209 |
| 2003/0151191 | A1 | * | 8/2003 | Watase | 271/242 |
| 2004/0094892 | A1 | * | 5/2004 | Kuramoto | 271/227 |
| 2005/0156373 | A1 | * | 7/2005 | Konagaya | 271/226 |
| 2005/0206073 | A1 | * | 9/2005 | Fukushima | 271/226 |
| 2007/0126176 | A1 | * | 6/2007 | Ha | 271/245 |
| 2009/0214278 | A1 | * | 8/2009 | Kawachi et al. | 399/397 |
| 2009/0324311 | A1 | * | 12/2009 | Matsumoto | 399/400 |

FOREIGN PATENT DOCUMENTS

| | | | | |
|---|---|---|---|---|
| JP | H64-36357 | U | | 3/1989 |
| JP | S64-36357 | A | | 3/1989 |
| JP | H05-124753 | A | | 5/1993 |
| JP | 06100208 | A | * | 4/1994 |
| JP | 2005-200183 | A | | 7/2005 |
| JP | 2007-131403 | A | | 5/2007 |

* cited by examiner

*Primary Examiner* — Kaitlin Joerger
*Assistant Examiner* — Prasad Gokhale
(74) *Attorney, Agent, or Firm* — Baker Botts L.L.P.

(57) ABSTRACT

A movable component which can be moved between a protruding position in which the movable component protrudes from the outer chute into a curved path toward an inner chute so as to be able to contact the recording medium and a retracted position in which the degree of protrusion of the movable component from the outer chute into the curved path is smaller than the degree of protrusion in the protruding position, and the movable component is moved from the protruding position to the retracted position at a timing on or after a first timing and before a second timing.

10 Claims, 6 Drawing Sheets

RECORDING APPARATUS

CROSS REFERENCE TO RELATED APPLICATION

The present application claims priority from Japanese Patent Application No. 2009-68878, which was filed on Mar. 19, 2009, the disclosure of which is herein incorporated by reference in its entirety.

BACKGROUND OF THE INVENTION

1. Field of the Invention

The present invention relates to a recording apparatus which forms an image on a recording medium.

2. Description of the Related Art

In a publicly-known laser printer having feed rollers, resist rollers downstream of the feed rollers, and a sheet guide which is provided between these sets of rollers and constitutes a sheet conveyance path, the sheet guide is composed of two guides, i.e. an inner chute and an outer chute. The outer chute has a protrusion which protrudes toward the inner chute so as to narrow the sheet conveyance path and a curved portion which bulges away from the inner chute at the downstream of the protrusion so as to widen the sheet conveyance path.

In this arrangement, a sheet conveyed by the feed rollers is forced to move along the inner chute by the protrusion, and further conveyed to the resist rollers. Hitting the resist rollers, the sheet warps inside a large space formed by the curved portion. The leading edge of the sheet strongly hits the resist rollers on account of the warping, with the result that the tilting of the leading edge of the sheet is corrected.

SUMMARY OF THE INVENTION

When the tilting of the leading edge of the sheet is being corrected according to the technology above, i.e. so-called registration is being carried out, the sheet outwardly warps to contact the inner surface of the outer chute. When this registration takes too long, the sheet warps to form an S-shape from the curved portion to the protrusion, with the result that the sheet is bended. When the sheet is bended in this way, the bended part absorbs the transporting force exerted to the sheet by the feed rollers, thereby decreasing the force to hit the leading edge of the sheet against the resist rollers and decreasing the registration capability.

An object of the present invention is to provide a recording apparatus which can prevent the registration capability from decreasing.

A recording apparatus includes: an upstream roller pair; a downstream roller pair; an inner chute and an outer chute; and a moving mechanism. The upstream roller pair pinches and conveys a recording medium. The downstream roller pair has a slower conveyance speed than the upstream roller pair and is able to pinch a leading edge of the recording medium which is being pinched by the upstream roller pair. The inner chute and an outer chute are separated from each other and form a curved path between the upstream roller pair and the downstream roller pair. The recording medium passes through the curved path. A movable component is movable between a protruding position in which the movable component protrudes from the outer chute into the curved path toward the inner chute and a retracted position in which the degree of protrusion of the movable component from the outer chute into the curved path is smaller than the degree of protrusion in the protruding position. The moving mechanism causes the movable component to move between the protruding position and the retracted position. The moving mechanism causes the movable component to move from the protruding position to the retracted position at a timing on or after a first timing and before a second timing. The first timing is a timing before the leading edge of the recording medium having been conveyed by the upstream roller pair reaches a pinching position where the recording medium is pinched by the downstream roller pair, and the first timing is further limited to the earliest timing in a period, which period is defined such that at least a part of the recording medium is apart from the outer chute when the leading edge of the recording medium reaches the pinching position of the downstream roller pair, if the movable component is moved from the protruding position to the retracted position at a timing in the period. The second timing is a timing after the leading edge of the recording medium having been conveyed by the upstream roller pair reaches the pinching position of the downstream roller pair, and is the very instant at which the recording medium entirely contacts the inner surface of the outer chute between the pinching position of the downstream roller pair and a contact position where the movable component contacts the recording medium.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
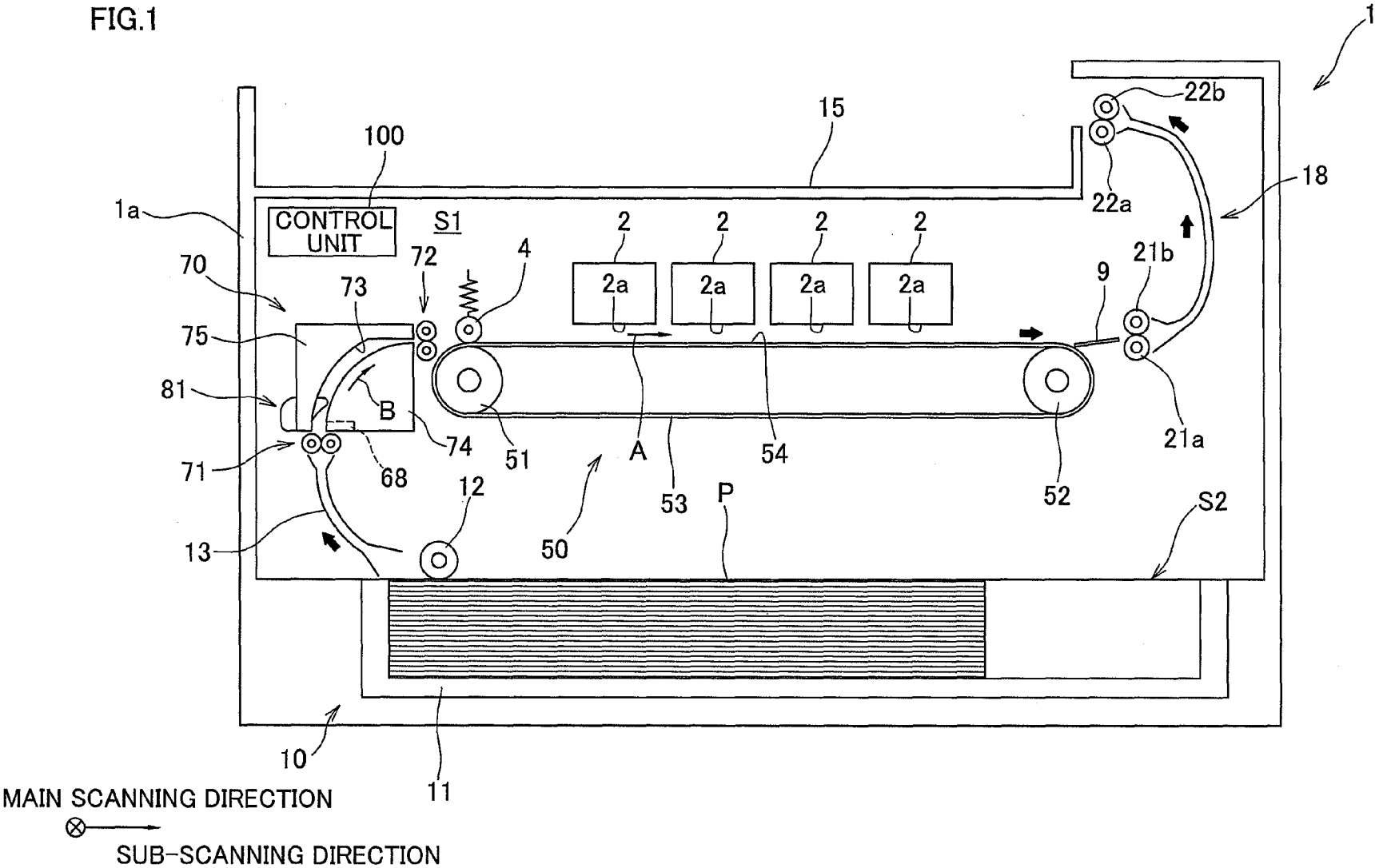
FIG. 1 is a simplified profile of the internal structure of an inkjet printer according to First Embodiment of the present invention.

As shown in FIG. 1, an inkjet printer 1 of First Embodiment of the present invention has a rectangular casing 1*a*, and is provided with a sheet discharge area 15 at top. The space inside the casing 1*a* is divided into two spaces S1 and S2 from top to bottom. In the space S1, four inkjet heads 2 ejecting magenta, cyan, yellow, and black inks and a conveying unit 50 which conveys sheets in a conveyance direction A are provided in this order. In the space S2 provided is a sheet supply unit 10. In the space S1, furthermore, a sheet feeding unit 70 which sends, to the conveying unit 50, a sheet P sent out from the sheet supply unit 10. The inkjet printer 1 further includes a control unit 100 which controls the operations above. In the present embodiment, a direction in parallel to the conveyance direction A for conveying a sheet P by the conveying unit 50 is a sub-scanning direction, whereas a direction which is orthogonal to the sub-scanning direction and in parallel to the horizontal plane is a main scanning direction.

Inside the inkjet printer 1 formed is a conveying path on which a sheet P is conveyed from the sheet supply unit 10 to the sheet discharge area 15 along the thick arrow shown in FIG. 1. The sheet supply unit 10 includes a sheet feed cassette 11 which can store plural stacked sheets P, a pickup roller 12 which sends out a sheet P from the sheet feed cassette 11, and a pickup motor 121 (see FIG. 4) which is controlled by the control unit 100 and rotates the pickup roller 12. The pickup roller 12 sends out the topmost sheet P among the plural sheets P stacked and stored in the sheet feed cassette 11.

In the left side of the conveying unit 50 in FIG. 1 provided are a conveyance guide 13 which curves and extends toward the top from the sheet feed cassette 11 and a sheet feeding unit 70 which sends to the conveying unit 50 a sheet P which has passed through the conveyance guide 13.

Figure 2A:
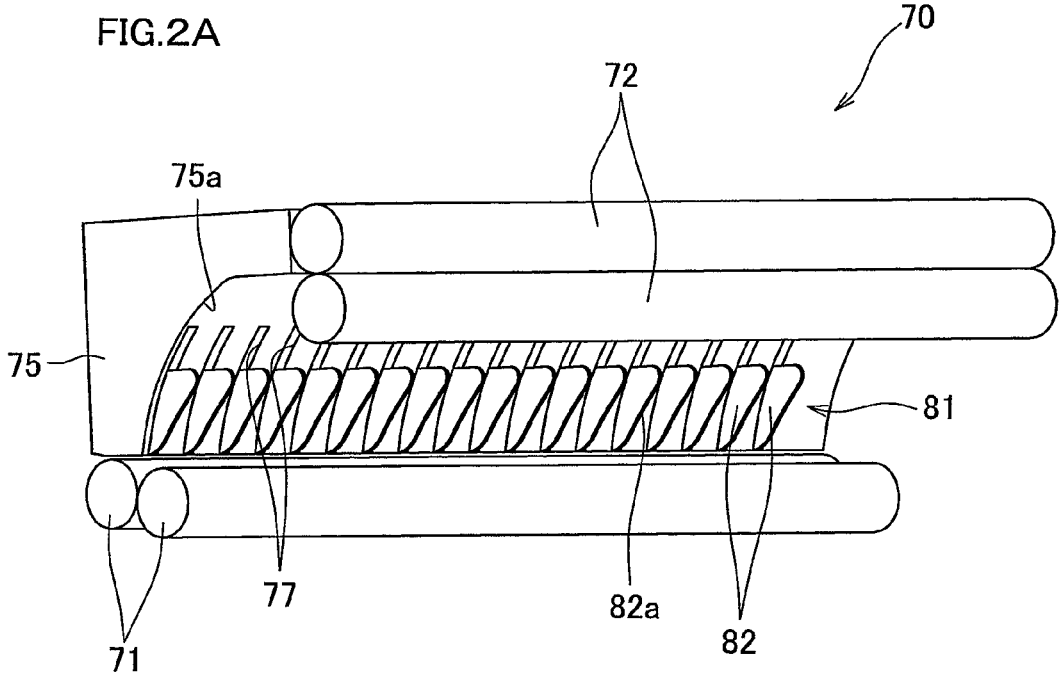
FIG. 2A and FIG. 2B are perspective views of a sheet feeding unit of FIG. 1, observing the unit in different directions.
Figure 3A:
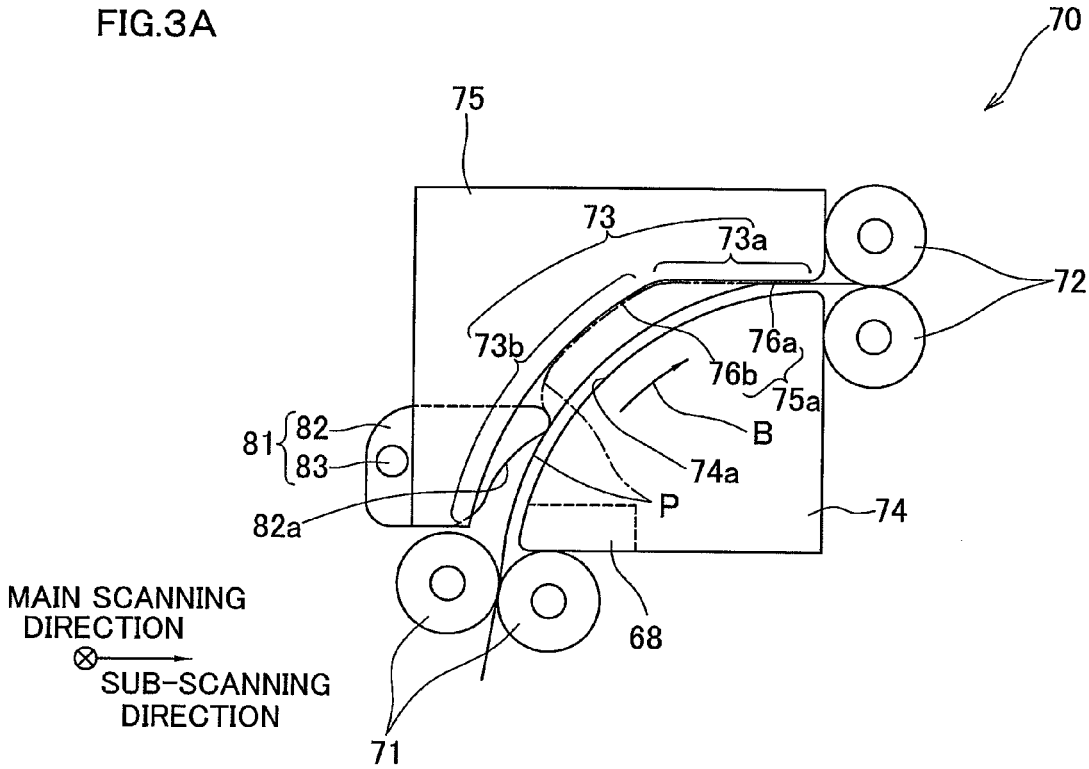
FIG. 3A and FIG. 3B are profiles of the sheet feeding unit of FIG. 1, when a movable component of the sheet feeding unit is in the protruding position and in the retracted position, respectively.
Figure 3B:
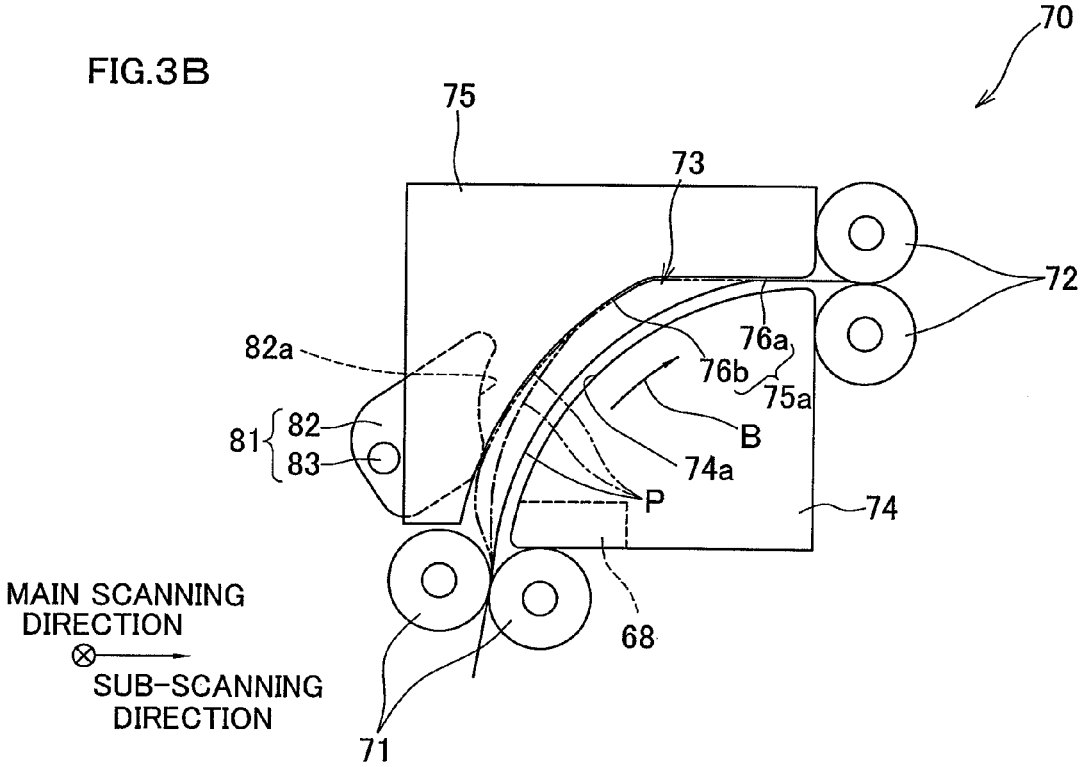
Figure 4:
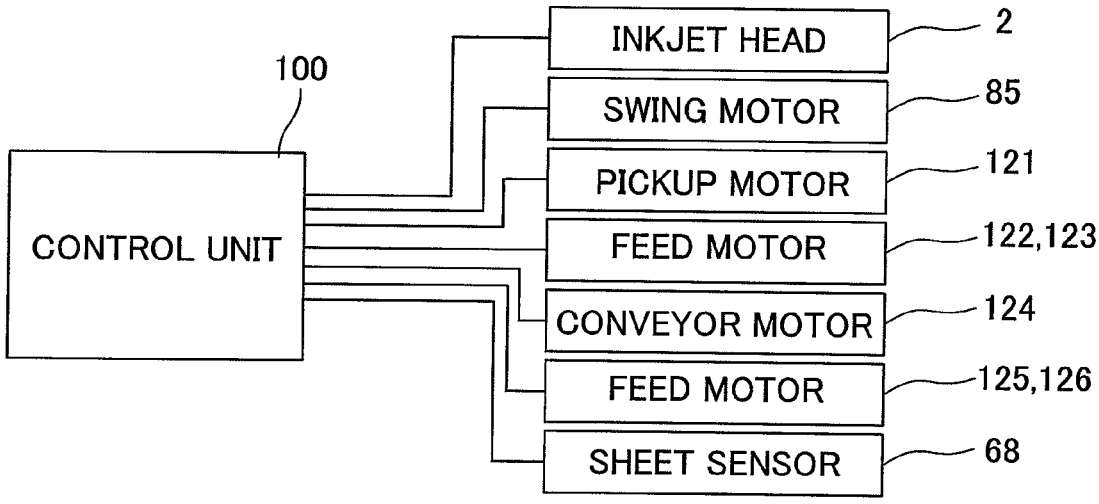
FIG. 4 shows the control system of the inkjet printer of FIG. 1.

As shown in FIGS. 1-3, the sheet feeding unit 70 includes an upstream roller pair 71 and a downstream roller pair 72 which sandwich and convey the sheet P, an inner chute 74 and an outer chute 75 which are provided between the roller pairs 71 and 72, and two feed motors 122 and 123 (see FIG. 4). The two feed motors 122 and 123 which are provided for conveying a sheet P in the conveyance direction B are controlled by the control unit 100. The feed motor 122 rotates one roller of the upstream roller pair 71 whereas the feed motor 123 rotates one roller of the downstream roller pair 72. The other rollers of these roller pairs 71 and 72 are driven rollers and rotate in accordance with the conveyance of the sheet P. The distance between the roller pairs 71 and 72 along the conveyance direction B is arranged to allow the downstream roller pair 72 to pinch at least the leading edge of the sheet P which is being sandwiched between the upstream roller pair 71. FIG. 2A illustrates only the outer chute 75, and the inner chute 74 is omitted from the figure.

Figure 2B:
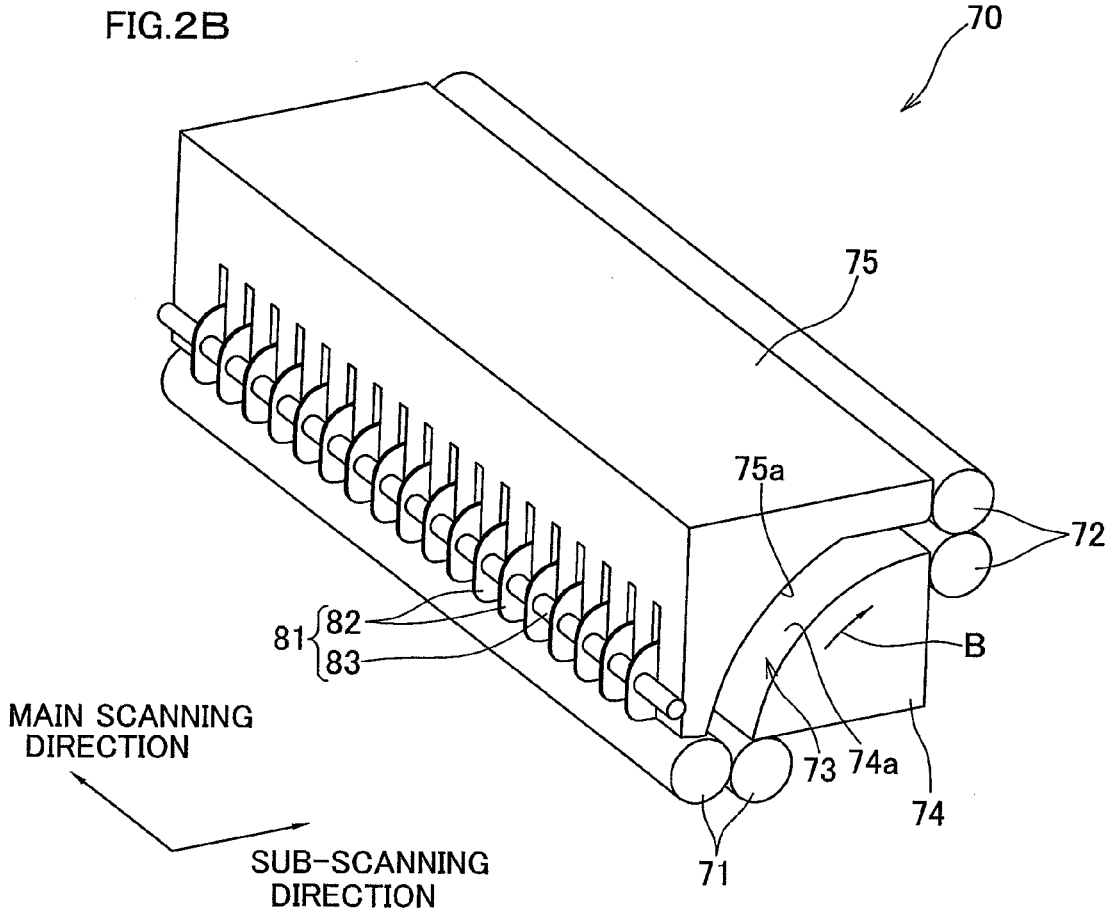

The inner surface 74*a* of the inner chute 74 which surface opposes the outer chute 75 and the inner surface 75*a* of the outer chute 75 which surface opposes the inner chute 74 are both curved as shown in FIG. 2A and FIG. 2B. The inner surface 74*a* bulges toward the outer chute 75. The inner and outer chutes 74 and 75 are separated from each other to allow a curved path 73 to be formed between the inner surfaces 74*a* and 75*a*.

As shown in FIG. 3A, the inner surface 75*a* has a horizontal portion 76*a* near the downstream end and a curved portion 76*b* which extends from the vicinity of the downstream end toward the upstream end and bulges away from the inner chute 74. With these components, the curved path 73 has a tapered path 73*a* which is provided between the horizontal portion 76*a* and the inner surface 74*a* and tapered towards the downstream end in the conveyance direction B and a buffer path 73*b* which is connected to the upstream end of the tapered path 73*a*. This buffer path 73*b* is provided for warping a sheet P to contact the inner surface 75*a* (curved portion 76*b*) when the leading edge of the sheet P reaches the position of pinching by the downstream roller pair 72 and the registration of the sheet P is being carried out, as discussed later. As shown in FIGS. 2A and 2B, the outer chute 75 is provided with plural slits 77 which perforate the outer chute 75 in the sub-scanning direction and are formed along the main scanning direction.

As shown in FIG. 3A, at the upstream end of the inner chute 74 provided is a sheet sensor 68. This sheet sensor 68 is provided upstream of a later-described position where the movable component 81 contacts the sheet P. The sheet sensor 68 detects the leading edge and the tail edge of the sheet P conveyed by the upstream roller pair 71 and sends a resulting detection signal to the control unit 100.

The sheet feeding unit 70 includes a movable component 81 which can protrude from the outer chute 75 to the inside of the curved path 73 towards the inner chute 74 and a swing motor 85 (see FIG. 4) which is controlled by the control unit 100 and swings the movable component 81. The movable component 81 has a plurality of plates 82 arranged along the main scanning direction and a shaft 83 which extends in the main scanning direction and to which the plates 82 are fixed. Each plate 82 is provided in a slit 77, and the shaft 83 is provided outside the outer chute 75. The shaft 83 is supported at the both ends by the casing 1*a* so as to be rotatable. To one end of the shaft 83, the driving force of the swing motor 85 is applied via an unillustrated transmission mechanism. In other words, the transmission mechanism and the swing motor 85 constitute a moving mechanism for moving the movable component 81.

The surface of the plate 82 which surface opposes the inner surface 74*a* and is as thick as the plate has a slope 82*a* as shown in FIG. 3A. This slope 82*a* is formed so that the angle between the slope 82*a* and a portion of the sheet P which portion is upstream in the conveyance direction of the point at which the sheet P contacts the plate 82 is an acute angle. This allows the upstream roller pair 71 to smoothly convey the sheet P. Furthermore, the slope 82*a* has a curved surface convex toward the outer chute 75 when the movable component 81 is in the later-described protruding position. This allows the upstream roller pair 71 to further smoothly convey the sheet P.

In the arrangement above, as the swing motor 85 is driven under the control of the control unit 100 and runs forward, the shaft 83 rotates anti-clockwise as shown in FIG. 3A. As a result, the movable component 81 moves from the protruding position (see FIG. 3A) where the plate 82 partly protrudes from the inner surface 75*a* to the curved path 73 to the retracted position (see FIG. 3B) where the protruding part of the component 82 is withdrawn into the slit 77 so that the movable component 81 does not protrude into the curved path 73. In the protruding position, the tip of the plate 82 is slightly separated from the inner surface 74*a*. On the other hand, as the swing motor 85 runs backward, the shaft 83 rotates clockwise as shown in FIG. 3A. As a result of this, the movable component 81 moves from the retracted position to the protruding position. When a sheet P is conveyed by the upstream roller pair 71 while the movable component 81 is in the protruding position, the leading edge of this sheet P contacts the curved surface 82*a* and the sheet P is guided such that the sheet P is conveyed along the inner surface 74*a* while being apart from the curved portion 76*b*.

As shown in FIG. 1, the conveying unit 50 has a pair of belt rollers 51 and 52, an endless conveyor belt 53 looped around the rollers 51 and 52, a support roller 4, and a conveyor motor 124 (see FIG. 4) which generates a driving force for rotating the belt roller 52. The outer circumferential surface of the conveyor belt 53, i.e. the conveying surface 54 is subjected to a silicone treatment to have adhesion. The support roller 4 is disposed above the belt roller 51 to sandwich, together with the belt roller 51, the conveyor belt 53. The support roller 4 is biased toward the conveying surface 54 by an elastic component such as a spring, and pushes a sheet P having been conveyed by the downstream roller pair 72 onto the conveying surface 54.

In this arrangement, the belt roller 52 is rotated clockwise in FIG. 1 under the control of the control unit 100, so that the conveyor belt 53 rotates. In accordance with the rotation of the conveyor belt 53, the belt roller 51 and the support roller 4 also rotate because they are driven rollers. Then the sheet P conveyed from the sheet feeding unit 70 is supported by the conveying surface 54 and further conveyed in the conveyance direction A. When the sheet P supported by and conveyed on conveying surface 54 serially passes right under the four inkjet heads 2, the control unit 100 controls the inkjet heads 2 so that inks of the respective colors are ejected onto the sheet P. In this way, a desired color image is formed on the sheet P.

Immediately downstream the conveying unit 50 in the conveyance direction A is provided a peeling plate 9. This peeling plate 9 peels the sheet P off from the conveying surface 54 as the tip of the plate is inserted into the space between the sheet P and the conveyor belt 53.

As shown in FIG. 1, in the right side of the inkjet head 2 is provided four feed rollers 21*a*, 21*b*, 22*a*, and 22*b* and a conveyance guide 18 which is provided between the feed rollers 21*a* and 21*b* and between the feed rollers 22*a* and 22*b*. The feed rollers 21*b* and 22*b* are rotated by feed motors 125 and 126 (see FIG. 4) which are controlled by the control unit 100. In this arrangement, the feed rollers 21*b* and 22*b* are rotated under the control of the control unit 100 so that a sheet P discharged from the conveying unit 50 passes through the conveyance guide 18 while being pinched by the feed rollers 21*a* and 21*b* and is further conveyed toward the upper part of FIG. 1. The sheet is then sent to the sheet discharge area 15 while being pinched by the feed rollers 22*a* and 22*b*. The feed rollers 21*a* and 22*a* rotate in response to the conveyance of the sheet because they are driven rollers.

Now, the control unit 100 will be described with reference to FIG. 4. The control unit 100 is constituted by, for example, a general-purpose personal computer (PC). Such a computer has hardware such as a Central Processing Unit (CPU), a Read Only Memory (ROM), a Random Access Memory (RAM), and a hard disc, and the hard disc stores various kinds of software including a program for controlling the operation of the printer 1. The control unit 100 controls the inkjet head 2 and the motors 85 and 121-126. Moreover, the control unit 100 is connected to the sheet sensor 68 and a detection signal is sent from the sheet sensor 68 to the control unit 100.

The printing operation of the printer 1, the operation of the sheet feeding unit 70 in particular, will be discussed. When print data for forming an image on a sheet P is sent from a PC to the control unit 100, the control unit 100 drives the pickup motor 121 so that a sheet P is sent out from the sheet supply unit 10.

The control unit 100 then controls the feed motor 122 so as to rotate the upstream roller pair 71 in order to convey the sheet P in the conveyance direction B. As a result, the sheet P having passed through the conveyance guide 13 is conveyed to the inside of the curved path 73 while being pinched by the upstream roller pair 71. At the same time, the sheet sensor 68 detects the leading edge of the sheet P and sends a detection signal indicating the detection to the control unit 100. In addition, since the movable component 81 is in the protruding position in this case, the sheet P contacts the plate 82 and hence the sheet P is conveyed to the downstream roller pair 72 along the inner surface 74*a*.

When a predetermined time has passed since the control unit 100 received the detection signal from the sheet sensor 68, the swing motor 85 is controlled so that the movable component 81 is moved from the protruding position to the retracted position. This predetermined time is calculated by dividing the distance between the sheet sensor 68 and the downstream roller pair 72 by the conveyance speed of the sheet P by the upstream roller pair 71. Therefore, when the leading edge of the sheet P reaches the sheet pinching position of the downstream roller pair 72 (i.e. the position where the sheet P is pinched by the downstream roller pair 72), the movable component 81 is moved from the protruding position to the retracted position. At this position, the sheet P is along the inner surface 74*a* as indicated by the full line in FIG. 3B, and hence a large space is formed between the sheet P and the curved portion 76*b*. The rotation of the downstream roller pair 72 has been stopped.

Thereafter, the leading edge of the sheet P abuts the downstream roller pair 72. The sheet conveyance by the upstream roller pair 71 is carried out in this state, i.e. in the state in which the sheet P is at the sheet pinching position, so that the registration of the sheet P is carried out. During this registration, the sheet P is warped to contact the inner surface 75*a* as indicated by the two-dot chain line in FIG. 3B. The leading edge of the sheet P does not therefore receive an excessive force. As the sheet P is warped to contact the inner surface 75*a*, the upstream roller pair 71 does not easily slip on the sheet P and hence the sheet P is hardly damaged by the slipping of the upstream roller pair 71.

Thereafter, the control unit 100 controls the feed motor 123 so that the motor 123 starts to run when a predetermined time has passed since the leading edge of the sheet P abuts the downstream roller pair 72 (i.e. reaches the pinching position). As a result, the sheet P is conveyed in the conveyance direction A. This predetermined time is equal to a time from the timing at which the leading edge reaches the pinching position to the timing at which the sheet P becomes to fully contact the inner surface 75*a* between the pinching position and the contact position. The predetermined time may be calculated based on the conveyance speed of the sheet P by the upstream roller pair 71 and the shape of the curved path 73, or may be determined in advance based on an actually-measured time. The conveyance speed of the sheet P by the downstream roller pair 72 is slightly slower than the conveyance speed of the sheet P by the upstream roller pair 71. Because of this, further registration of the sheet P is possible while the sheet P is conveyed by the roller pairs 71 and 72, with the result that the conveyance accuracy of the sheet P is improved. In addition to the above, the control unit 100 drives the conveyor motor 124 so that the sheet P is conveyed in the conveyance direction A. In this way, the sheet P having been conveyed by the downstream roller pair 72 is now conveyed by the conveying unit 50.

Furthermore, the control unit 100 controls the inkjet heads 2 so that each inkjet head 2 ejects ink when the sheet P passes through the area opposing said each inkjet head 2. An image is formed at a predetermined position on the sheet P in this manner. The timing to eject ink is determined based on the time elapsed from the detection of the leading edge of the sheet P by the sheet sensor 68 (i.e. the quotient of division of the distance between the sheet sensor 68 and each head 2 by the conveyance speed of the sheet P).

The control unit 100 controls the swing motor 85 so that the movable component 81 is moved from the retracted position to the protruding position after a predetermined time elapsed from the detection of the tail edge of the sheet P by the sheet sensor 68. This predetermined time is a time length from the detection of the tail edge of the sheet P by the sheet sensor 68 to the timing at which the tail edge of the sheet P passes through the contact position, and is calculated by dividing the distance between the sheet sensor 68 and the contact position by the sheet conveyance speed by the upstream roller pair 71. Therefore, even after the movable component 81 is moved to the protruding position, the sheet P does not contact the movable component 81. In other words, when the printing onto the sheet P is being carried out by the inkjet heads 2, the movable component 81 does not interfere the conveyance of the sheet P, so that the quality of the image formed on the sheet P is not deteriorated. In the present embodiment, the contact position is slightly upstream from the midway point between the roller pairs 71 and 72.

Thereafter, the control unit 100 drives the feed rollers 21*b* and 22*b* so that the sheet P having the image is conveyed from the conveyor belt 53 to the sheet discharge area 15 via the conveyance guide 18. As such, the sheet P is discharged to the sheet discharge area 15 and the printing operation onto the sheet P finishes.

In the embodiment above, the movable component 81 is moved from the protruding position to the retracted position when the leading edge of the sheet P reaches the pinching position. In this regard, the aforesaid effect is achievable also by moving the movable component 81 from the protruding position to the retracted position at any timing (hereinafter, moving timing) on or after a later-described first timing and before a later-described second timing.

The first timing is a timing before the leading edge of the sheet P having been conveyed by the upstream roller pair 71 reaches the pinching position where the sheet P is pinched by the downstream roller pair 72, and the first timing is further limited to the earliest timing in a period, which period is defined such that at least a part of the sheet P is apart from the outer chute 75 when the leading edge of the sheet P reaches the pinching position of the downstream roller pair 72, if the movable component 81 is moved from the protruding position to the retracted position at a timing in the period.

An example of the moving timing is a timing when the leading edge of the sheet P passes through the contact position. When the movable component 81 is moved from the protruding position to the retracted position at this timing, The sheet P is conveyed in the conveyance direction B while the leading edge and the following part thereof contacts the inner surface 75*a*. When the leading edge of the sheet P reaches the pinching position, a part of the sheet P which part is downstream from the midway point between the roller pairs 71 and 72 contacts the inner surface 75*a* whereas a part of the sheet P which part is upstream from the midway point between the roller pairs 71 and 72 is apart from the inner surface 75*a*, as shown by the single-dot chain line in FIG. 3B. Provided that the movable component 81 is moved from the protruding position to the retracted position at a moving timing earlier than the example above, this moving timing is before the first timing if the sheet P entirely contacts the outer chute 75 in the curved path 73 when the leading edge of the sheet P reaches the pinching position.

As such, if the movable component 81 is moved from the protruding position to the retracted position at a moving timing on or after the first timing, the sheet P is partly apart from the inner surface 75*a* when the leading edge of the sheet P reaches the pinching position. It is therefore possible to carry out the registration of the sheet P after the leading edge of the sheet P reaches the pinching position.

The second timing is a timing after the leading edge of the sheet P having been conveyed by the upstream roller pair 71 reaches the pinching position of the downstream roller pair 72, and is the very instant at which the sheet P to entirely contacts the inner surface 75*a* between the pinching position of the downstream roller pair 72 and the contact position. In other words, the second timing is a timing at which the leading edge of the sheet P reaches the pinching position, the registration of the sheet P is carried out, and the sheet P becomes to contact the inner surface 75*a* from its leading edge to the contact position (i.e. a part of the sheet P indicated by the single-dot chain line in FIG. 3A). Moving the movable component 81 from the protruding position to the retracted position before this second timing is advantageous because the registration of the sheet P can be continued until the sheet P becomes entirely contacting the inner surface 75*a* between the pinching position and the contact position, and it is possible to prevent the sheet P from bending. It is preferable to calculate or actually measure the first and second timings in accordance with each type (item identifier) of sheets and store data about the timings in the control unit 100 in advance.

In the inkjet printer 1 of the present embodiment, the registration of the sheet P is possible after the leading edge of the sheet P reaches the pinching position, by moving the movable component 81 from the protruding position to the retracted position at a moving timing on or after the first timing. When the leading edge of the sheet P reaches the pinching position of the downstream roller pair 72 and the registration of the sheet P is carried out, the movable component 81 is moved from the protruding position to the retracted position before the second timing at which the sheet P entirely contacts the inner surface 75*a* of the outer chute 75 between the pinching position and the contact position. For this reason it is possible to prevent the sheet P from being bended along the shape of the plate 82, thereby preventing the registration capability from deteriorating.

In addition to the above, the movable component 81 is moved from the protruding position to the retracted position when the leading edge of the sheet P reaches the pinching position of the downstream roller pair 72, so that the sheet P is entirely apart from the outer chute 75 between the pinching position and the contact position, when the leading edge of the sheet P reaches the pinching position. In other words, the entirety of the sheet P in the curved path 73 is apart from the inner surface 75*a*. This maximizes the time for the registration and hence the registration of the sheet P is effectively carried out. Furthermore, since the sheet sensor 68 and the control unit 100 which controls the operation of the swing motor 85 in accordance with the timing of the detection of the sheet P by the sheet sensor 68 are included, the plates 82 can stably operate.

The printer of the present embodiment has a simple arrangement such that the movable component 81 is moved between the protruding position and the retracted position as the moving mechanism swings the movable component 81. Furthermore, since the movable component 81 does not protrude from the outer chute 75 to the space inside the curved path 73 when it is in the retracted position, the time for the registration is long as compared to a case where the movable component 81 protrudes toward the space inside the curved path 73 when it is in the retracted position, and hence the registration of the sheet P is further effectively carried out.

Figure 5A:
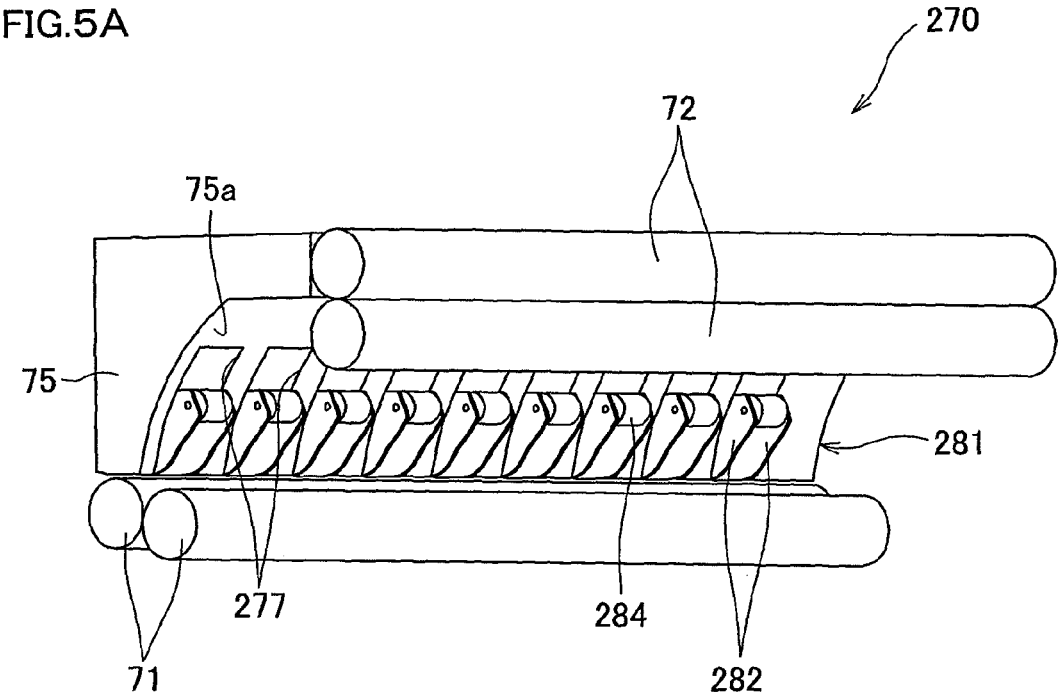
FIG. 5A and FIG. 5B are a perspective view and a profile of a sheet feeding unit of an inkjet printer according to Second Embodiment of the present invention.
Figure 5B:
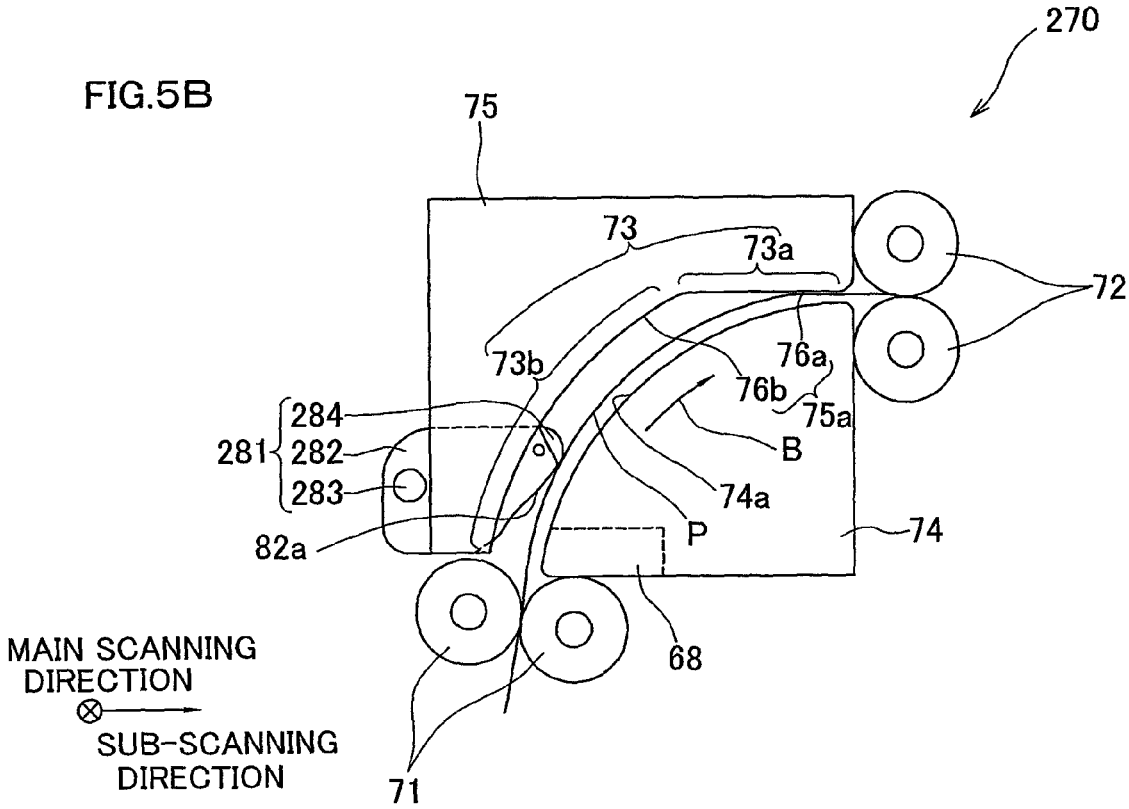

Now, an inkjet printer according to Second Embodiment of the present invention will be described with reference to FIG. 5A and FIG. 5B. The inkjet printer the present embodiment is basically identical with the inkjet printer of First Embodiment except that a sheet feeding unit 270 is different in terms of arrangement from the sheet feeding unit 70 of the First Embodiment, and these printers are controlled in more or less the same manner. It is noted that components identical with those of First Embodiment are denoted by the same reference numerals and the descriptions thereof are omitted. It is also noted that FIG. 5A only illustrates the outer chute 75, and the inner chute 74 is omitted from the figure.

In the present embodiment, the sheet feeding unit 270 includes: plural plates 282 and a shaft 283 which are more or less identical with the above-described plates 82 and shaft 83; and a movable component 281 having plural guide rollers 284. The inner surface 75*a* of the outer chute 75 is provided with plural slits 277 along the main scanning direction, and two plates 282 are provided for each slit 277. The central axis of the guide roller 284 extends in the main scanning direction, and one guide roller 284 is rotatably provided for the two plates 282 of each slit 277. The guide roller 284 is provided at the tips of the two plates 282 closest to the inner chute 74. The movable component 281 is arranged to be able to contact a sheet P conveyed by the upstream roller pair 71, when the component 281 is in the protruding position.

Because the guide roller 284 is provided at the tips of the plates 282, the sheet P having been conveyed by the upstream roller pair 71 is smoothly conveyed in the conveyance direction B.

Figure 6A:
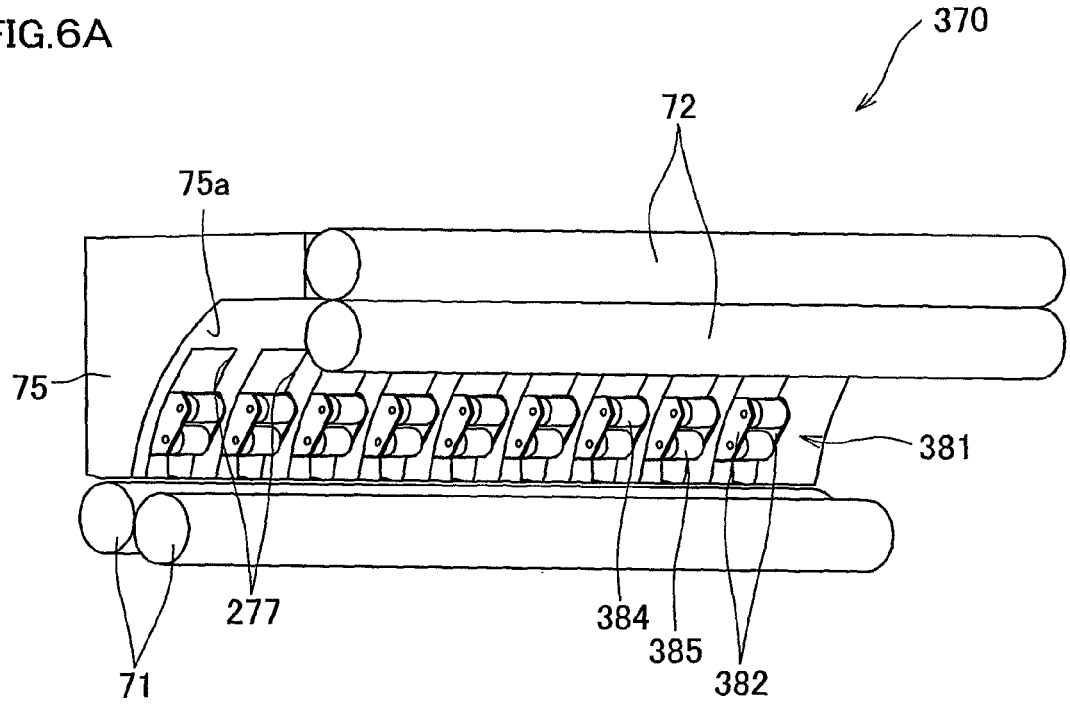
FIG. 6A and FIG. 6B are a perspective view and a profile of a sheet feeding unit of an inkjet printer according to Third Embodiment of the present invention.
Figure 6B:
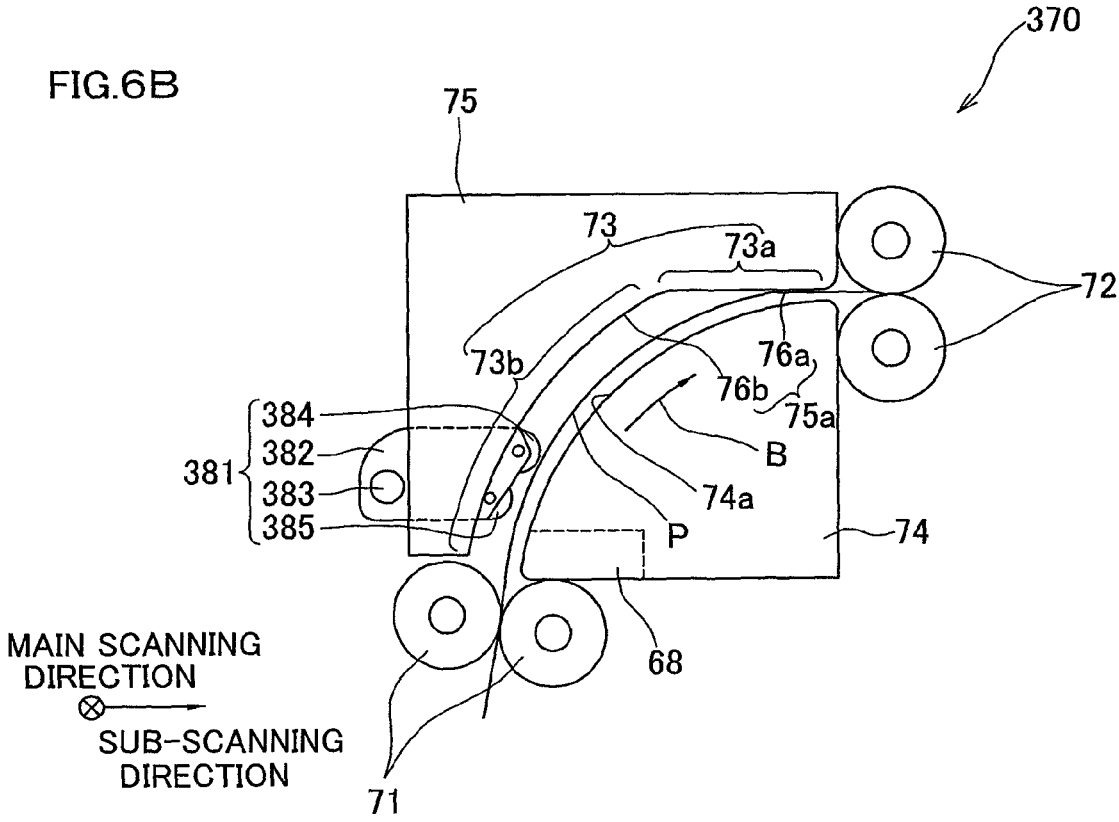

Finally, an inkjet printer according to Third Embodiment of the present invention will be described with reference to FIG. 6A and FIG. 6B. The inkjet printer of the present embodiment is substantially identical with the inkjet printers according to First and Second Embodiments and is controlled in a substantially identical manner, except that the arrangement of a sheet feeding unit 370 is different from those of the sheet feeding units 70 and 270. It is noted that components identical with those of First and Second Embodiments are denoted by the same reference numerals and the descriptions thereof are omitted. It is also noted that FIG. 6A only illustrates the outer chute 75, and the inner chute 74 is omitted from the figure.

In the present embodiment, the sheet feeding unit 370 includes: plural plates 382 and a shaft 383 which are more or less identical with the above-described plates 82 and shaft 83; and a movable component 381 having plural guide rollers 384 and 385. In the same manner as Second Embodiment, each slit 277 is provided with two plate 382 in the present embodiment. The central axis of each of the guide rollers 384 and 385 extends along the main scanning direction, and each roller is rotatably supported by the two plates 382 of each slit 277. More specifically, the guide roller 384 is provided above the guide roller 385. The guide roller 384 is provided at the tips of the two plates 382 closest to the inner chute 74. On the other hand, the guide roller 385 is farther from the inner chute 74 than the guide roller 384. These guide rollers 384 and 385 are arranged so that, when the movable component 381 is in the protruding position, the guide roller 385 contacts a sheet P conveyed by the upstream roller pair 71 before the guide roller 384 contacts the sheet so that the sheet P is guided toward the inner chute 74, and then the sheet P is guided by the guide roller 384 along the inner surface 74*a*.

Consequently, it is possible to keep the sheet P having been conveyed by the upstream roller pair 74*a* to move along the inner surface 74*a* only by the two guide rollers 384 and 385, while preventing the sheet P from contacting the plate 382. The sheet P having been conveyed by the upstream roller pair 71 is therefore smoothly conveyed in the conveyance direction B.

In First to Third Embodiments above, the swing motor is driven under the control of the control unit 100 and the movable components 81, 281, and 381 are moved from the protruding position to the retracted position. Alternatively, the moving mechanism for moving the movable component may be a biasing component which biases the movable component toward the inner chute 74. The biasing component in this case is, for example, an elastic component such as a spring. The biasing force of the biasing component is arranged to be enough to move the movable component to the retracted position before the sheet P reaches the pinching position and the registration is carried out and hence a force sufficient for bending the sheet P in accordance with the shape of the movable component is applied to the sheet P. In other words, the movable component is moved from the protruding position to the retracted position by the force generated when the sheet P in the curved path 73 is warped to contact the inner surface 75*a* on account of the registration of the sheet P. The apparatus is simplified with this arrangement because it is unnecessary to control the movement of the movable component and to provide the swing motor.

In the three embodiments above, the movable component does not protrude from the outer chute to the inside of the curved path when it is in the retracted position. Alternatively, the movable component may protrude into the curved path as long as the degree of protrusion in the retracted position is smaller than the degree in the protruding position. Furthermore, the above-described three embodiments are arranged so that the movable component is swung. Alternatively, the movable component may be translated rather than swung.

In the three embodiments above, the downstream roller pair 72 is stopped when the registration of the sheet P is carried out as the leading edge of the sheet P reaches the pinching position. Alternatively, the downstream roller pair 72 may be rotated along with the upstream roller pair 71, when the registration is carried out. In this case, the conveyance speed of the sheet P by the downstream roller pair 72 is arranged to be slower than the speed by the upstream roller pair 71. It is also noted that the present invention may be used for a recording apparatus which has a record head which is not an inkjet head.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A recording apparatus comprising:

an upstream roller pair which pinches and conveys a recording medium;

a downstream roller pair which has a slower conveyance speed than the upstream roller pair and is able to pinch a leading edge of the recording medium which is being pinched by the upstream roller pair;

an inner chute and an outer chute which are separated from each other and form a curved path between the upstream roller pair and the downstream roller pair, the recording medium passing through the curved path, a movable component which is movable between a protruding position in which the movable component protrudes from the outer chute into the curved path toward the inner chute and a retracted position in which the degree of protrusion of the movable component from the outer chute into the curved path is smaller than the degree of protrusion in the protruding position;

a moving mechanism which causes the movable component to move between the protruding position and the retracted position;

a sensor configured to detect the leading edge of the recording medium passing through the curved path; and a control unit configured to control the moving mechanism based on a detection signal of the sensor, wherein, the moving mechanism causes the movable component to move from the protruding position to the retracted position at a timing on or after a first timing and before a second timing, the first timing is a timing before the leading edge of the recording medium having been conveyed by the upstream roller pair reaches a pinching position where the recording medium is pinched by the downstream roller pair, and the first timing is further limited to the earliest timing in a period, which period is defined such that at least a part of the recording medium is apart from the outer chute when the leading edge of the recording medium reaches the pinching position of the downstream roller pair, if the movable component is moved from the protruding position to the retracted position at a timing in the period, and the second timing is a timing after the leading edge of the recording medium having been conveyed by the upstream roller pair reaches the pinching position of the downstream roller pair, and is the very instant at which the recording medium contacts the inner surface of the outer chute across a majority of the area between the pinching position of the downstream roller pair and a contact position where the movable component contacts the recording medium.

2. The recording apparatus according to claim 1, wherein, the moving mechanism causes the movable component to move from the protruding position to the retracted position when the leading edge of the recording medium having been conveyed by the upstream roller pair reaches the pinching position of the downstream roller pair.

3. The recording apparatus according to claim 1, further comprising:

a recording unit by which an image is formed on the recording medium; and a conveyor mechanism which conveys the recording medium having been conveyed by the downstream roller pair to a position opposing the recording unit, wherein, the moving mechanism causes the movable component to move from the retracted position to the protruding position after a tail edge of the recording medium passes through the contact position of the movable component.

4. The recording apparatus according to claim 1, wherein, the movable component has a plurality of plates which are arranged in a direction orthogonal to a conveyance direction of the recording medium in the curved path along the recording medium, and are able to contact the recording medium having been conveyed by the upstream roller pair when the movable component is in the protruding position.

5. The recording apparatus according to claim 4, wherein, a surface of each of the plates nearest to and opposing the inner chute forms an acute angle with a part of the recording medium, the part being, in the conveyance direction, upstream a contact position where the recording medium contacts the plates.

6. The recording apparatus according to claim 5, wherein, the surface is curved and approaches toward the inner chute when the movable component is in the protruding position.

7. The recording apparatus according to claim 1, wherein, at one end of the movable component supported rotatably is a roller, the roller being able to contact the recording medium having been conveyed by the upstream roller pair when the movable component is in the protruding position and having a central axis extending in a direction orthogonal to the conveyance direction of the recording medium in the curved path.

8. The recording apparatus according to claim 1, wherein, the movable component has a roller which is able to contact the recording medium having been conveyed by the upstream roller pair when the movable component is in the protruding position, and has a central axis extending in a direction orthogonal to the conveyance direction of the recording medium in the curved path.

9. The recording apparatus according to claim 1, wherein, the moving mechanism causes the movable component to move between the protruding position and the retracted position by swinging the movable component.

10. The recording apparatus according to claim 1, wherein, the movable component is arranged not to protrude from the outer chute into the curved path when the movable component is in the retracted position.

* * * * *